US008956183B2

(12) United States Patent
Tsai

(10) Patent No.: US 8,956,183 B2
(45) Date of Patent: Feb. 17, 2015

(54) RADIALLY UNIFORM SPRING-BIASED INTRA-POLE PLUG CONNECTOR AND TRANSFORMER OUTSIDE THE TRUNK CONFIGURATION FOR ELECTRIC ARTIFICIAL TREE

(71) Applicant: Evergreen Tree Limited, Hong Kong (CN)

(72) Inventor: Cheng-che Tsai, Hong Kong (CN)

(73) Assignee: Evergreen Tree Limited, Hong Kong (HK)

( * ) Notice: Subject to any disclaimer, the term of this patent is extended or adjusted under 35 U.S.C. 154(b) by 151 days.

(21) Appl. No.: 13/902,451

(22) Filed: May 24, 2013

(65) Prior Publication Data

US 2014/0349517 A1 Nov. 27, 2014

Related U.S. Application Data

(63) Continuation-in-part of application No. 13/726,742, filed on Dec. 26, 2012, now Pat. No. 8,753,152.

(51) Int. Cl.
*H01R 13/60* (2006.01)
*H01R 13/518* (2006.01)

(52) U.S. Cl.
CPC ..... *H01R 13/518* (2013.01)
USPC ..... 439/540.1

(58) Field of Classification Search
USPC ..... 439/540.1, 577, 668, 638, 135
See application file for complete search history.

(56) References Cited

U.S. PATENT DOCUMENTS

| | | | | |
|---|---|---|---|---|
| 4,199,210 | A * | 4/1980 | Trott | 439/201 |
| 4,416,495 | A * | 11/1983 | Regan | 439/192 |
| 6,951,405 | B2 | 10/2005 | Yao | |
| 7,132,139 | B2 | 11/2006 | Yang | |
| 8,105,664 | B2 | 1/2012 | Tsai | |
| 8,298,633 | B1 | 10/2012 | Chen | |
| 8,454,186 | B2 | 6/2013 | Chen | |
| 8,454,187 | B2 | 6/2013 | Chen | |
| 2004/0120687 | A1 | 6/2004 | Fung | |
| 2013/0108808 | A1 * | 5/2013 | Leung et al. | 428/18 |

* cited by examiner

*Primary Examiner* — Edwin A. Leon
(74) *Attorney, Agent, or Firm* — Flachsbart & Greenspoon, LLC

(57) ABSTRACT

A radially uniform spring-biased intra-pole plug connector and transformer outside the trunk configuration for an electric artificial tree is described. The radially uniform plug comprises a springed-tip and a prong, and allows the tree trunk segments to be connected at any point along their 360 degree circumference. The plug connector resembles the structure of a car cigarette lighter. A mold is used to sandwich the plug within the trunk. A plug portion of the plug connector is housed in one trunk segment, and a receptacle portion is housed in a different trunk segment, such that when the trunk segments are assembled, the plug is connected, illuminating the tree. The plug allows the electrical wiring to be hidden and housed within the trunk, providing safety, convenience to the user and giving the tree a cleaner appearance. The transformer outside the trunk configuration makes the trunk safer, more lightweight and less bulky.

7 Claims, 13 Drawing Sheets

RADIALLY UNIFORM SPRING-BIASED INTRA-POLE PLUG CONNECTOR AND TRANSFORMER OUTSIDE THE TRUNK CONFIGURATION FOR ELECTRIC ARTIFICIAL TREE

This application is a continuation-in-part and claims priority to U.S. patent application Ser. No. 13/726,742, filed Dec. 26, 2012, reproduced herein.

FIELD OF THE INVENTION

The present invention relates to artificial plants, and more particularly to electrically activated artificial Christmas trees.

BACKGROUND OF THE INVENTION

Christmas trees have long been used as a decoration to celebrate the holiday season. Artificial trees are typically used instead of real trees because of their safety, convenience, and ability to be stored and used more than once without degradation. Part of their convenience arises from their ability to be electrically configured prior to assembly. However, assembling and disassembling artificial trees can be cumbersome, especially when they contain a number of electric cords and lighting instrumentalities. Assembling the tree can also be cumbersome when the assembler has to locate a precise radial alignment for stacking the trunk segments for combining them together. Also, the assembler should be able to tell whether or not the trunk segments and lighting instrumentalities are actually connected. What is needed is an electrical connection configuration for an artificial tree to facilitate assembly and disassembly, such that the user does not have to locate and attach power cords in the bottom and middle section of the tree, does not have to locate a precise radial alignment during stacking, and is informed that the plug is connected. What is also needed is a way to make the trunk lightweight and less bulky, and resistant to dangerous overheating.

U.S. Pat. No. 7,132,139 describes a Christmas tree in which each hollow connecting rod has cords connecting the terminals of the first connecting member to the terminals of the second connecting member thereof. The user has to find and connect the plugs within the rods described in the '139 patent. Also, the '139 patent discusses neither a radially uniform spring-biased plug connector that allows trunk segments to be connected anywhere along their perimeter, nor a transformer outside trunk configuration to make the trunk safer, more lightweight and less bulky. U.S. Pat. No. 6,951,405 describes the use of artificial trunks and branches of a decorative tree to provide a set of decorative light strings along with the electrical connectors wound on the tree itself. The '405 patent does not describe a radially uniform spring-biased plug connector for a tree whose electrical plugs are hidden from the user inside the tree trunk pole solving a problem of convenience and appearance for end users. It also does not describe an assembly that informs the assembler that the plugs are connected with certainty, and that enables connection of the tree segments at any point along their 360 degree circumference. Also, the '405 patent does not discuss a transformer outside the trunk configuration to make the trunk safer, more lightweight and less bulky. U.S. Publication No. 2004/0120687 describes a Christmas tree having a segmented trunk and fiber optic decorative illumination for each tree segment wherein there is an individual light source or sources for the fiber optics of each segment. It does not describe a radially uniform spring-biased intra-pole plug connector for an artificial tree whose plugs and electrical wiring are hidden within the trunk of the tree, that enables insertion along any point along the 360 degree circumference of the trunk segments, and that informs the user that the plug is connected. The 2004/0120687 publication also does not disclose a transformer outside the trunk configuration.

SUMMARY OF THE INVENTION

The present invention relates to an electric artificial tree comprising a radially uniform spring-biased intra-pole plug connector, such that a user does not need to locate the electronic plugs used to illuminate the tree, that enables insertion along any point of the 360 degree circumference (or perimeter) of the trunk, and that informs the assembler that the plug is connected. Typically, one trunk segment will contain one half (plug portion) of the spring-biased plug, while the other trunk segment will contain the other half (receptacle portion). Thus, a person simply assembles the different tree segments together, and then the plug will be connected and the tree will be lit. The present invention also relates to a transformer outside the trunk, which makes the tree safer, more lightweight and less bulky. A mold is used to securely house the plug and receptacle within the metallic pole tree trunk segments. The structure of the plug connector resembles that of a car cigarette lighter (heretofore unknown in the artificial tree arts), and in the preferred embodiment, is cylindrical, or radially uniform.

DETAILED DESCRIPTION OF THE PREFERRED EMBODIMENTS

The present invention is directed to a radially uniform spring-biased intra-pole plug connector and transformer outside the trunk configuration for an electric artificial Christmas tree. A suitable tree for containing the invention herein is shown in U.S. Pat. No. 8,105,664, invented by the inventors of this application. The plug connector has a tip that is spring-biased so as to stay connected even during jiggling or disturbing the tree. A mold is used to house and secure the plug connector within the tree trunk segments. In the preferred embodiment, one-half of the plug connector (the plug portion) is housed in one trunk segment, while the other half of the plug connector (the receptacle portion) is housed in another trunk segment, such that when one trunk segment is inserted into the other, the plug connector will be connected, lighting the tree. The radial uniformity of the connector enables the trunk to be connected along any point along the 360 degree cylindrical circumference of the trunk. Another beneficial result of the plug connector is that users do not have to locate the wires when assembling and disassembling the tree, and the tree has a cleaner appearance and is safer. The invention is also directed to a transformer outside the trunk pole, making the trunk safer, more lightweight and less bulky.

Figure 1:
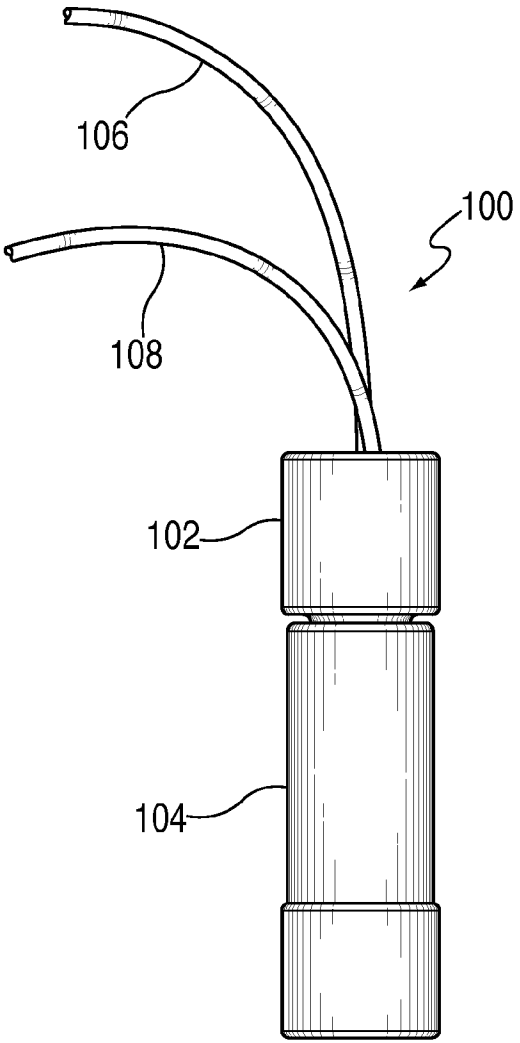
FIG. 1 is a view of a spring-biased intra-pole plug connector when connected.

FIG. 1 shows the radially uniform spring-biased intra-pole plug connector 100 when connected. In a preferred embodiment, the plug connector is cylindrically shaped, and the structure resembles that of a car cigarette lighter. Its diameter is approximately the same as the diameter of the artificial tree trunk, typically between 1" to 2". The plug connector 100 comprises two halves, a plug portion 102 and a receptacle portion 104. In the embodiment shown in FIG. 1, the diameter of the top and lower-most bottom portions of the molds are such that the plug connector will snugly fit into the trunk of the artificial tree. The plug portion 102 is designed to be sandwiched in one segment of the trunk, while the receptacle portion 104 is designed to be sandwiched in another segment of the trunk, such that when the segments are assembled, the plug connector is plugged in. The diameter of the mold receptacle portion 104 is larger at the bottom, by approximately 0.5" along its length. The mold can be made of any number of materials, including plastic or rubber. Two wires are shown coming out of the plug portion of the plug. The wires, in conjunction with the overall lighting system, serve to illuminate the tree. One tip wire 106 is coupled to the springed-tip 114, and the other prong wire 108 is coupled to the prong 116 of the plug connector.

Figure 2:
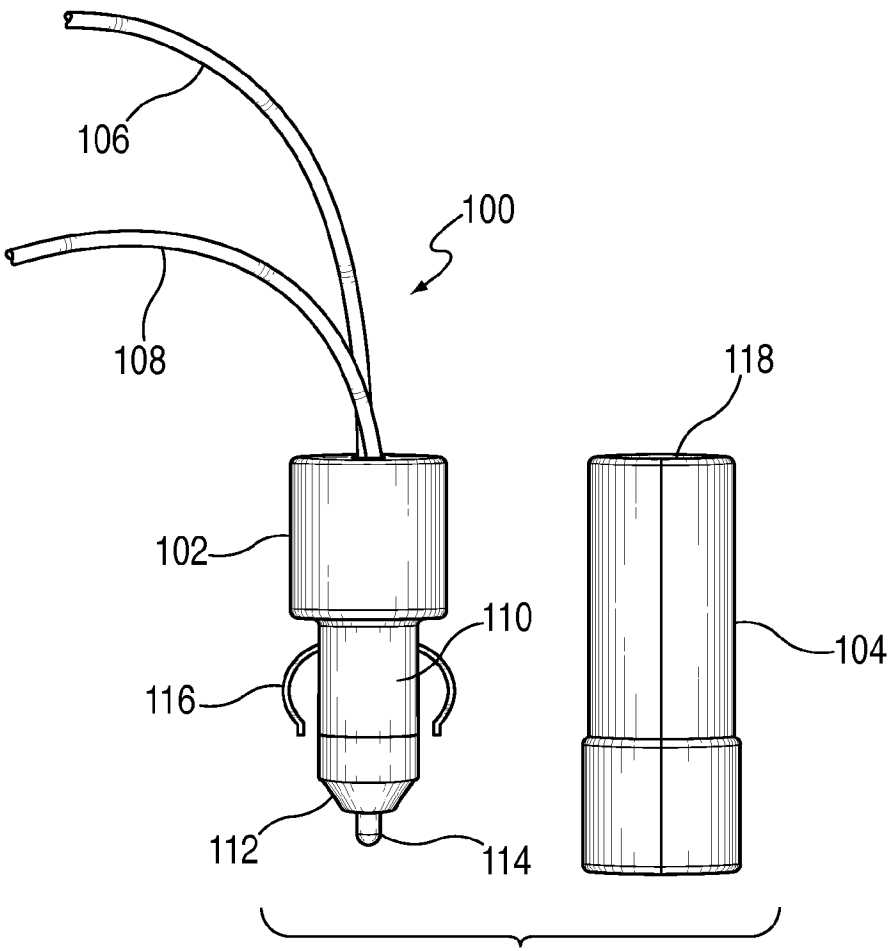
FIG. 2 is a view of the spring-biased intra-pole plug connector when disconnected.

FIG. 2 shows the plug connector when disconnected, with the single prong and springed-tip 114 of the plug 100 exposed. The mold portions 102 and 104 are each shown in a closed arrangement, the mold plug portion 102 comprising the plug and the mold receptacle portion 104 comprising a receptacle contact assembly 132 (not shown). A prong 116 is housed within a tubular casing 110, which is part of the mold plug portion 102. The prong 116 is curved along each of its leaves. The curved leaves of the prong 116 protrude from the tubular casing 110. The curvature of the prong 116 enables the plug connector 100 to be easily inserted into and removed from the receptacle portion 104 of the housing, thereby making an electrical connection in car cigarette lighter fashion. The end cap 112 is screwed onto the tubular casing 110. Each of the tubular casing 110 and end cap 112 are cylindrical and have a diameter allowing the plug to fit into an insertion hole 118 of the receptacle portion 104 of the plug 100. The tension of the prong 116 is large enough such that the plug 100 will be securely connected, but low enough for a user to easily connect the trunk segments and plug 100 together and to separate the trunk segments, disconnecting the plug 100.

Figure 4:
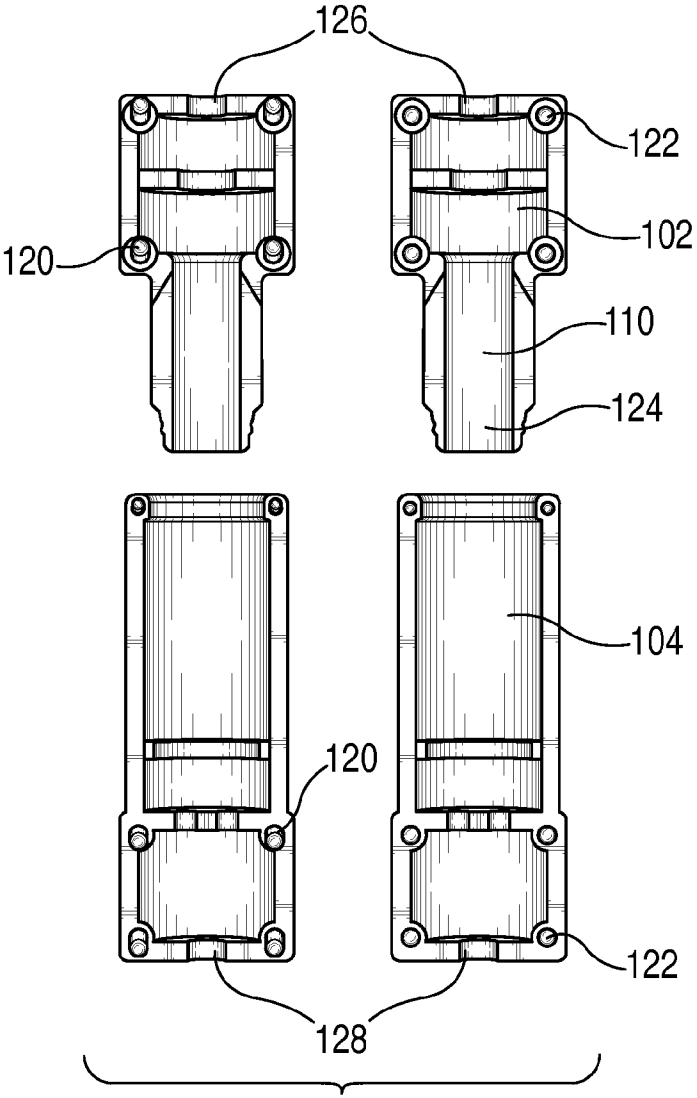
FIG. 4 is a view of the mold in an open arrangement with plug and receptacle portions shown separated.
Figure 3:
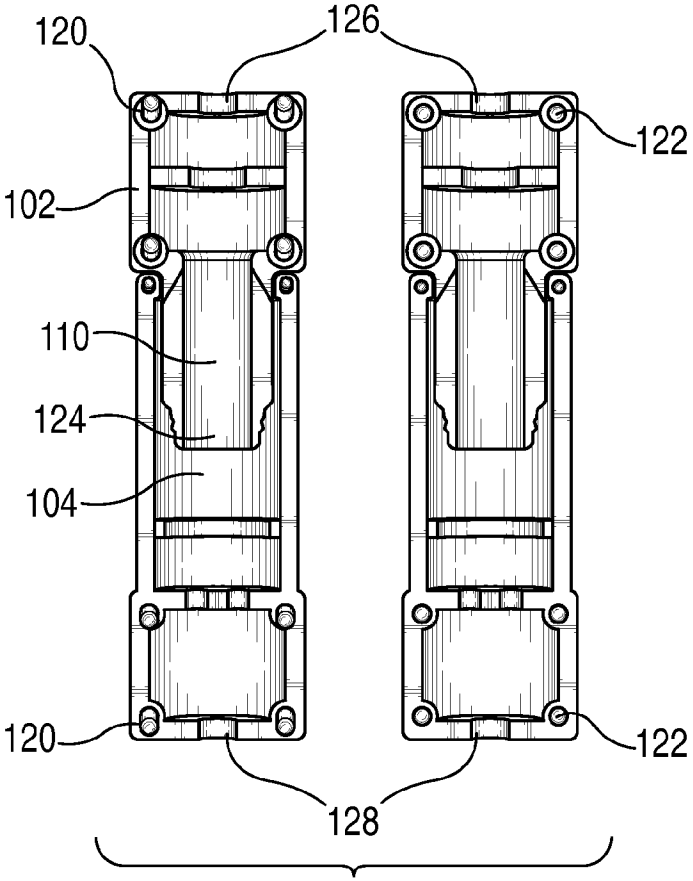
FIG. 3 is a view of a mold in an open arrangement with plug and receptacle portions connected.

FIG. 3 is a view of a plug connector mold in an open arrangement with mold receptacle 104 and mold plug 102 portions connected. As can be seen in FIG. 3, the diameter of the tubular casing 110 is of a size that allows it to fig snugly within the insertion hole 118 of the mold receptacle portion 104. The hole 118 is formed when the mold receptacle portion 104 is in a closed arrangement as in FIGS. 1 and 2. In FIG. 3, both the mold plug portion 102 and mold receptacle portion 104 contains fastening pegs 120, which fit into receiving apertures 122 of the other halves of the mold plug 102 and mold receptacle 104. In the embodiment shown in FIG. 3, the mold plug portion 102 contains four such fastening pegs 120, located at each corner of the mold when shown in an open arrangement, and at the edge of the diameter of the tubular mold when actually fastened. The four corresponding receiving apertures 122 are located symmetrically in the other half of the mold plug portion 102. The mold receptacle portion 104 contains six such fastening pegs 120, located at the edges of the diameter of the cylindrical mold receptacle portion 104 when in a closed arrangement, and six receiving apertures 122 are symmetrically located on the other half of the mold receptacle portion 104. At the tip of the tubular casing 110 is a screw head 124, onto which the plug top 112 is screwed when the mold plug portion 102 is fastened together. The mold plug portion 102 also contains an aperture 126, through which wires 106 and 108 pass and into the rest of the tree trunk. The mold receptacle portion 104 contains an aperture 128. FIG. 4 is a similar view of the mold in an open arrangement, except with the receptacle 104 and plug 102 portions shown separated, or when the plug would be disconnected.

Figure 6:
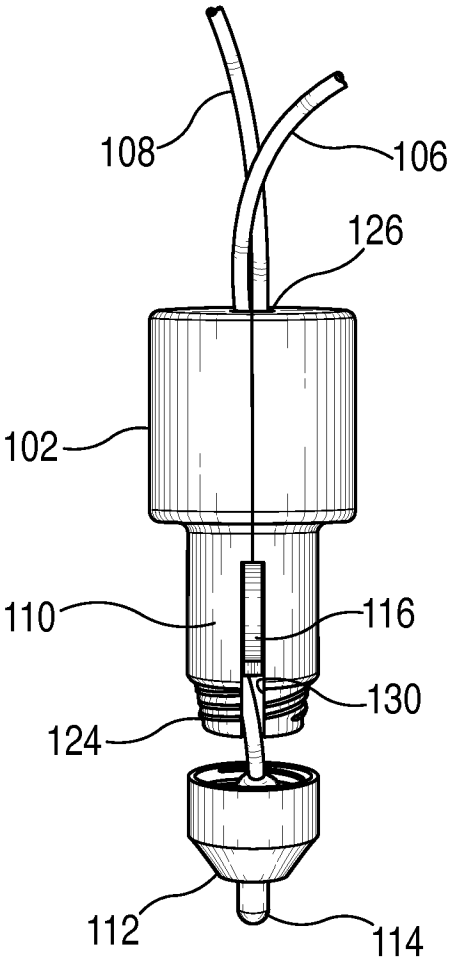
FIG. 6 is a top side view of the plug portion with its top unscrewed.
Figure 5:
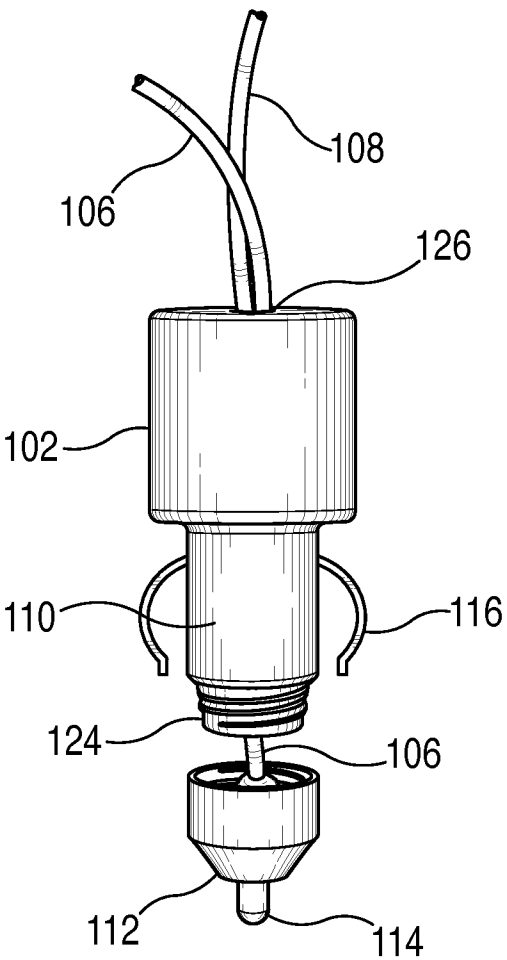
FIG. 5 is a top front view of the plug portion with its top unscrewed.

FIG. 5 is a top front view of the plug connector 100 with the cap 112 unscrewed. When the cap 112 is unscrewed, the prong 116 extends outward from the prong cavity 130. A tip wire 106 can be seen passing through the mold plug portion aperture 126 down through the tubular casing 110 and cap 112 all the way up to the springed-tip 114. FIG. 6 is a top side view of the plug 100 with the cap 112 unscrewed. The prong 116 is shown within the prong cavity 130 of the tubular casing 110.

Figure 8:
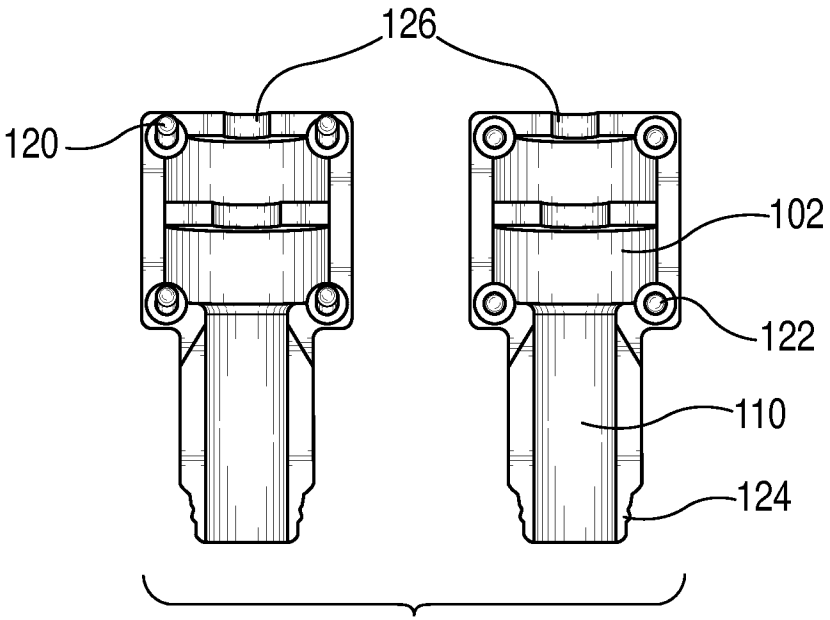
FIG. 8 is a view of the plug portion of a mold in an open arrangement.
Figure 7:
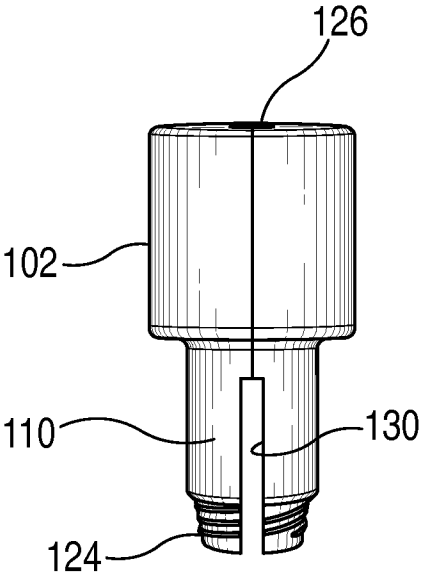
FIG. 7 is a top side view of the plug portion of the mold in a closed arrangement.

FIG. 7 is a top side view of the mold plug portion 102 in a closed arrangement. Looking downwards this way, the prong cavity 130 is easily visible. The screw head 124 is of a slightly smaller diameter than that of the tubular casing 110, so that when the cap 112 is actually screwed onto the mold plug portion, the cap 112 will be of the same diameter as that of the tubular casing 110. FIG. 8 is a view of the mold plug portion 102 in an open arrangement. As explained above with respect to FIGS. 3 and 4, the mold plug portion 102 contains fastening pegs 120 on one half of the mold plug portion. There are four in this case, but the number of fastening pegs and can be more or less depending on the size of the trunk. There are symmetrically located receiving apertures 122 in the other half of the mold plug portion 102. Also shown is the tubular casing 110 and aperture 126 (formed when the halves are connected) through which wires 106 and 108 pass, as well as the screw head 124.

Figure 9:
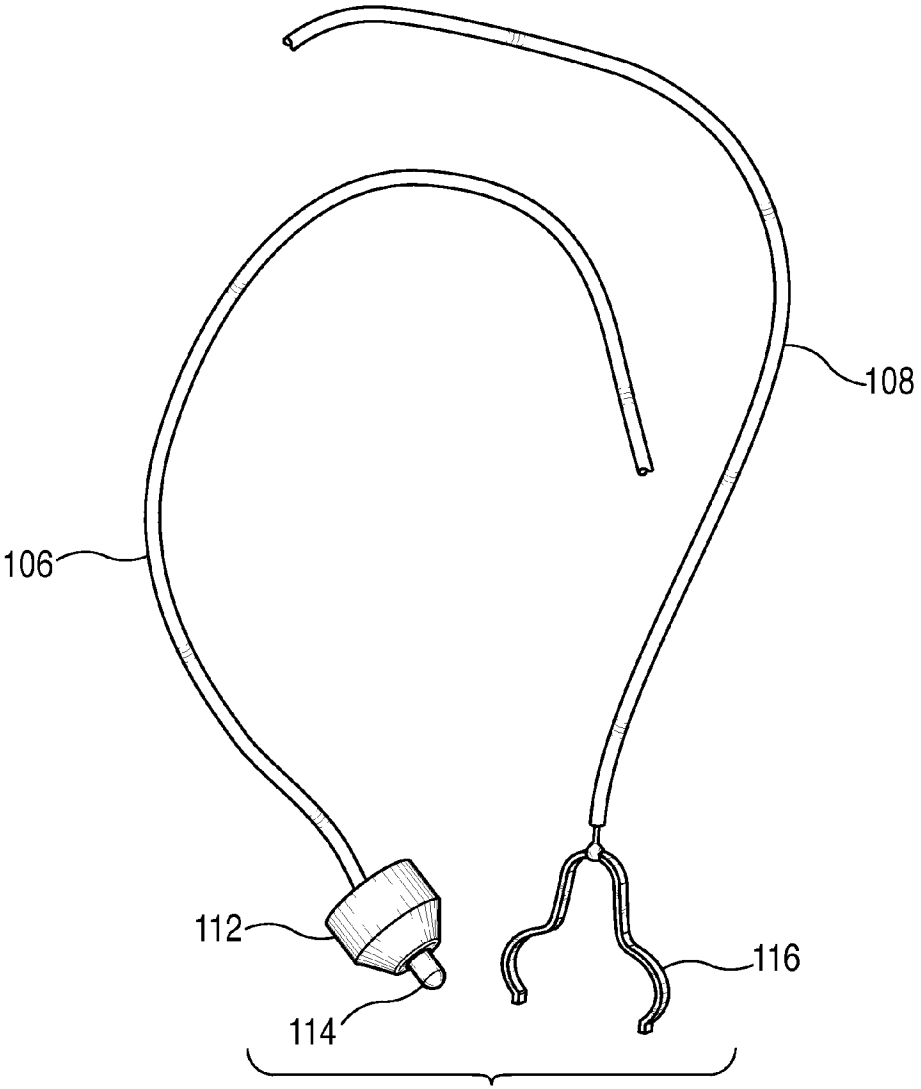
FIG. 9 is a view of electrical wiring, including a prong and spring wire.

FIG. 9 is a view of both the tip wire 106 and prong wire 108. Shown also are the cap 112 and springed-tip 114, to which to tip wire 106 is coupled. Coupled to the prong wire 108 is the prong 116. The prong 116 has a general "C" shape, which allows it to fit into the spring cavity 130 of the mold plug portion 102 and ultimately into the mold receptacle portion 104 when the plug 100 is plugged in. In this embodiment and shown in FIG. 9, the prong 116 is doubly-C shaped, such that the second "C" comes into contact with the receptacle contact assembly 132 within the receptacle portion 104 of the plug 100, transmitting the electrical current, while the first "C" resides within the upper half of the mold plug portion 102.

Figure 11:
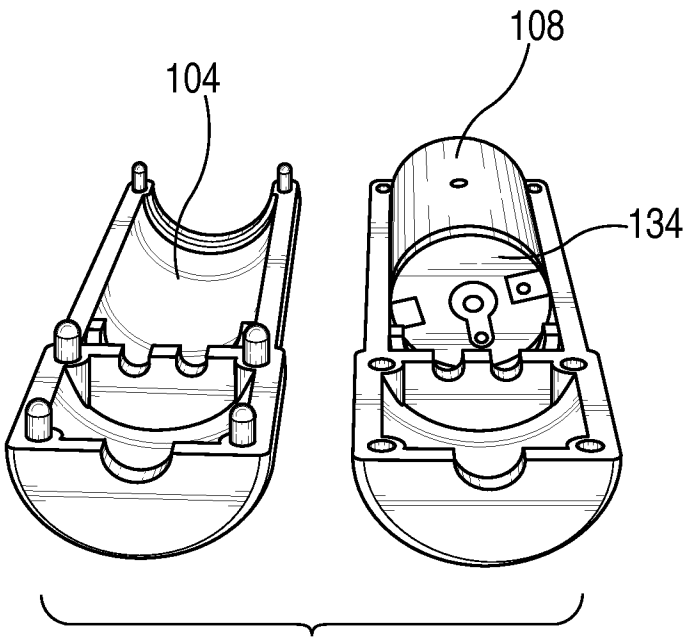
FIG. 11 is a bottom view of the receptacle portion mold in an open arrangement, showing a tip receiving contact of the receptacle contact assembly.
Figure 10:
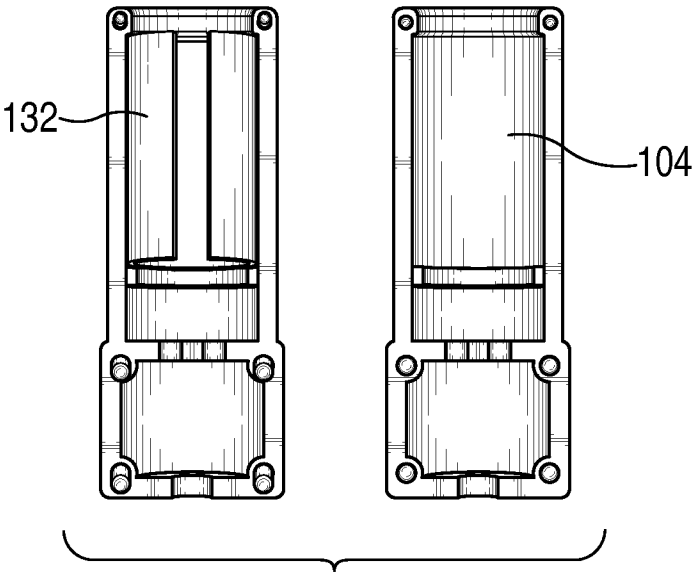
FIG. 10 is a view of the receptacle portion mold in an open arrangement containing a receptacle contact assembly.

FIG. 10 is a view of the mold of the receptacle portion 104 in an open arrangement, containing a receptacle contact assembly 132. When the plug connector is plugged in, the leaves of the prong 116 come into contact with the sides of the receptacle contact assembly 132. The receptacle contact assembly 132 thus acts as a conductor of electricity. The receptacle contact assembly 132 is cylindrically shaped and fits inside the cylindrical cavity of the mold receptacle portion 104. As can be seen in FIG. 10, the receptacle contact assembly 132 itself comprises a cavity along its edge. FIG. 11 is a bottom view of the receptacle portion mold in an open arrangement, showing a tip receiving contact 134 of the receptacle contact assembly 132. When the plug 100 is connected, the springed-tip 114 contacts (abuts) a circular target at the center of the tip receiving contact 134.

Figure 12:
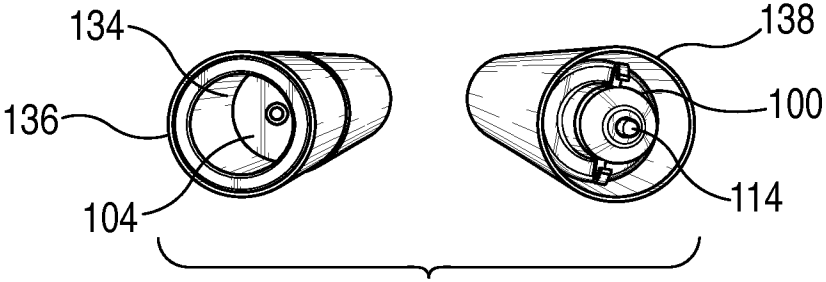
FIG. 12 is a top view of two trunk segments, each with a portion of the plug connector.
Figure 13:
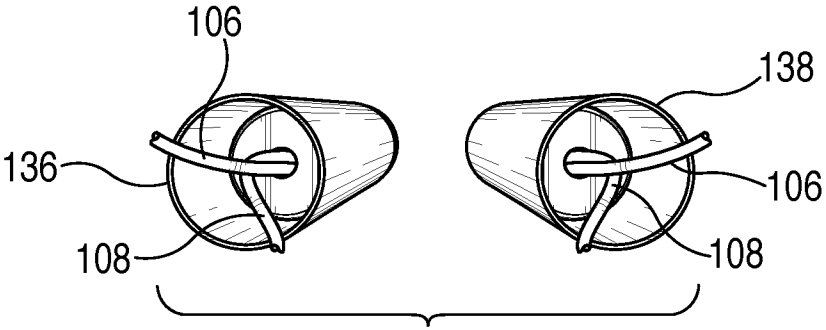
FIG. 13 is a top view of two trunk segments showing the electrical wiring inside.
Figure 14:
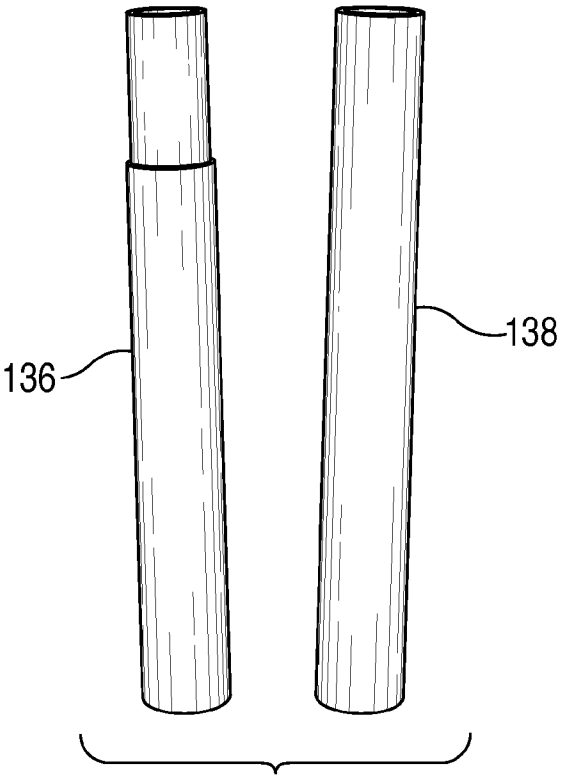
FIG. 14 is a side view of two trunk segments, one housing the plug portion and the other housing the receptacle portion.

FIG. 12 is a top view of two trunk segments, showing, from left to right, the mold receptacle portion 104 and mold plug portion 102 of the plug 100. The bottom trunk segment 136 houses the mold receptacle portion 104. The tip receiving contact 134 is also visible in FIG. 12. The springed-tip 114 fits into the small circular portion of the tip receiving contact 134 when the segments are connected. The top trunk segment 138 comprises the mold plug portion 102 of the plug 100. Notice here, in this embodiment, that the bottom trunk segment 136 contains a subsection of slightly smaller diameter than the rest of the trunk: approximately 0.1" less, extending about 1.5" along the trunk. This allows the bottom trunk segment 136 to fit inside the top trunk segment 138 and the plug to be connected. The remainder of the bottom trunk segment 136 has the same diameter as the top trunk segment 138, such that the entire trunk has the same diameter. FIG. 13 is a top view of two trunk segments showing the electrical wiring inside. Tip wire 106 and prong wire 108 run through both bottom trunk segment 136 and top trunk segment 138. Note that both trunk segments are uniform across the entire 360 degree circumference of the trunk. There are no separate indentations or other indications that inform the user of how the two trunk segments should be connected. This provides convenience to the end user, since the two segments are easier to combine. This is also a direct result of the radially uniform design of the plug 100 allowing it to be plugged in any point along its 360 degree rotation. Also, typically the bottom trunk segment 136 and top trunk segment 138 are not the only segments of the trunk. They are just the segments that comprise the components of the plug connector 100. FIG. 14 is a side view of two trunk segments, the bottom trunk segment 136 and the top trunk segment 138.

Figure 15:
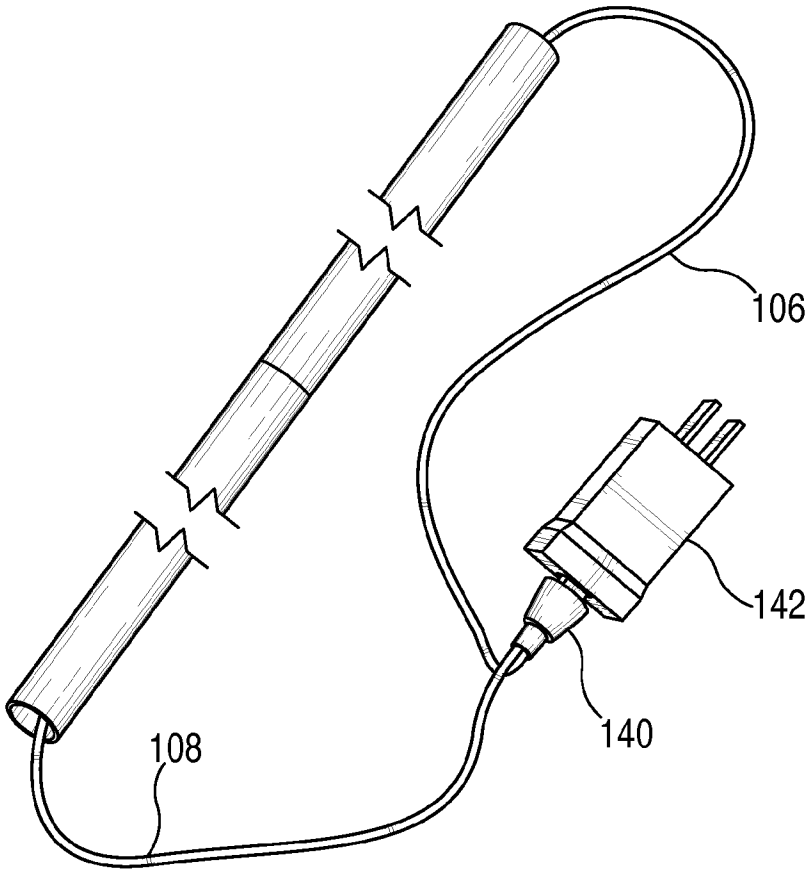
FIG. 15 is a view of a transformer outside the trunk, with wiring from the plug connector plugged into the transformer.

FIG. 15 is a view of the transformer outside the trunk, with wiring from the plug 100 plugged into the transformer. The tip wire 106 and prong wire 108 flow from the trunk and combine into a combination plug 140. The combination plug 140 fits into the transformer 142, which is then plugged into an electrical outlet. The transformer 142 acts as a power converter and converts household AC current into DC current. It is directly plugged into a household outlet. Keeping the transformer 142 outside the trunk pole makes the trunk safer, less bulky and more lightweight.

Figure 16:
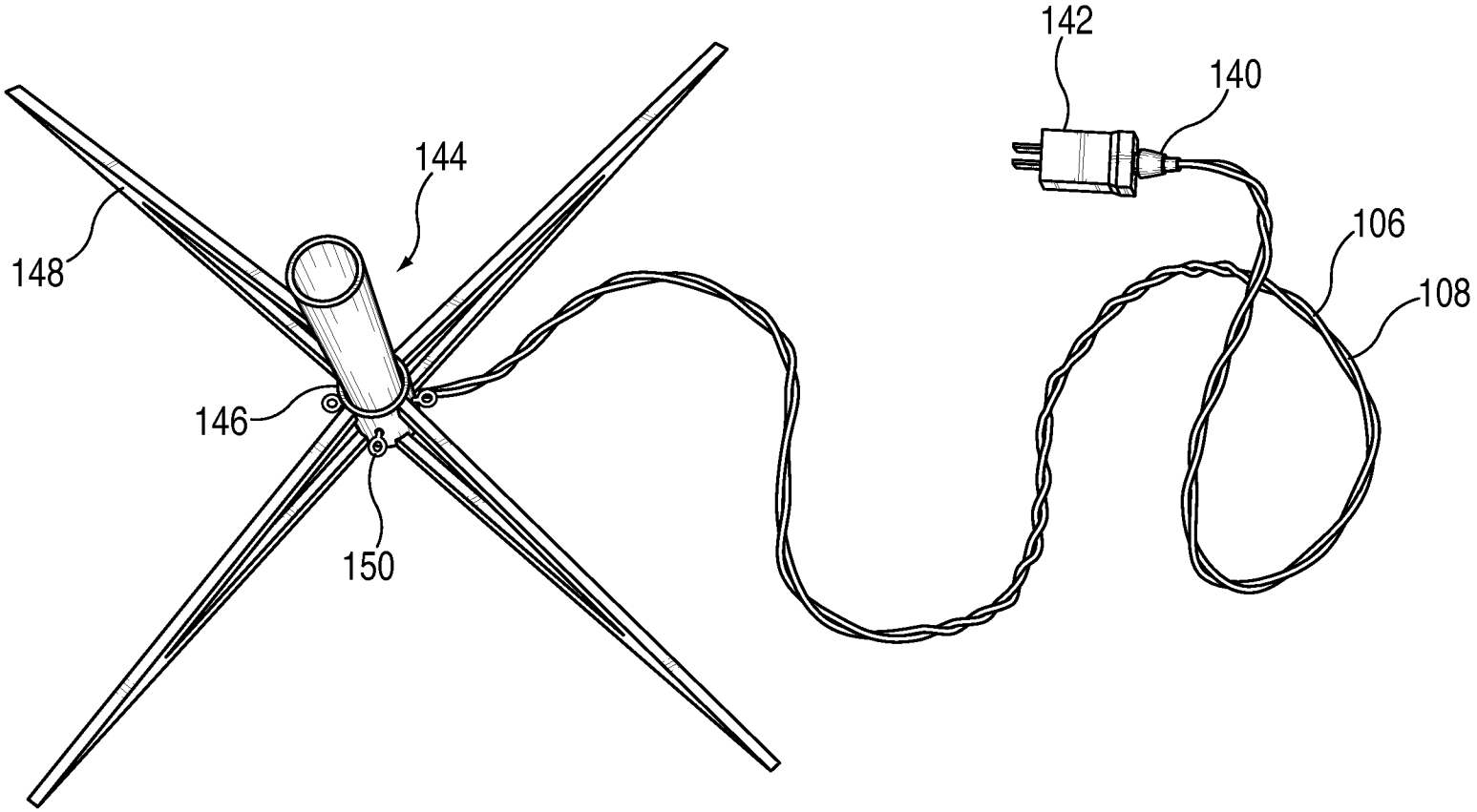
FIG. 16 is a view of a stand of an artificial tree, connected via wiring to the transformer.

FIG. 16 shows the stand 144 an artificial tree, connected to the transformer 142 via the combination plug 140, tip wire 106 and prong wire 108. The stand 144 contains a center piece 146 used to support the bottom of the bottom-most trunk section, four axes legs 148, and three eyebolts 150. The stand 144 is used to balance the tree so as to maintain it in an upright position, as well as to house the metallic trunk. In the shown embodiment, each axis leg 148 is comprised of two rods, one parallel to the floor and one angling downwards from the center piece 146. The eyebolts 150 secure the trunk to the center piece 146 once they are screwed in.

In normal use, an assembler would build the tree from the ground up as follows. First the assembler would locate the stand of the tree, form an "X", and place it on the ground where the tree is to be displayed. Next, the assembler would plug the transformer into an electrical outlet. This would give power to the stand instantly, and is the only time the assembler has to come into contact with an electrical outlet. Since the user only plugs in one plug once, the tree is a "one-plug" tree. Next, the assembler would insert each of the three eyebolts into the stand and begin twisting in a clock-wise motion for 2-3 rotations only, leaving enough room for the trunk pole to be inserted into the stand. The branches of the tree will typically already be inserted into the trunk segments. If not, the user would insert the branches into the trunk segments. Each segment of the trunk is labeled. For example, if there are four segments, the bottom most segment would be labeled 'D' and the top most segment 'A'. Therefore, in the case of four segments, the assembler would insert the 'D' labeled segment into the center piece 146 and further twist the eyebolts until they can no longer be twisted and the 'D' segment secure. The assembler then inserts the 'C' labeled segment into the 'D' labeled segment, etc., until all segments are connected. The plug connector 100 is intra-pole. Therefore, in this case, the plug portion 102 of the plug connector 100 would be sandwiched in the 'B' segment, and the receptacle portion 104 would be sandwiched in the 'C' segment. The plug connector is then automatically connected when the 'B' and 'C' trunk segments are connected. Each segment will light up upon its insertion into the previous segment. The tree will be lit completely when the segments of the tree are all combined.

The plug connector 100 has a spring-biased tip and is uniform across its radius. This structure offers several other advantages. For example, shaking the tree does not cause blinking. Blinking trees cause discomfort to consumers, even though there is no true safety concern. Note also that the plug connector's radial symmetry means that deformation during rough disassembly will not break it for next year—a problem that is not noticed for a long time when it occurs.

While the plug connector 100 has many advantages, there are certain design features that can be introduced in a plug for an electric artificial tree that will provide new functionality and promote better safety. Accordingly, another invention is a tube conductor plug connector 200. The tube plug connector 200 is intra-pole and radially uniform, allowing the plug to be connected at any point along its perimeter, which makes a tree easier to assemble since the user does not need to locate an exact insertion point. The tube plug connector 200 is capable of functioning at household voltages, approximately 110-240 VAC. The tube connector 200 provides the additional benefits of having a strong tubular metallic conductor that houses a tip which is not exposed to people/assemblers. Because the tube is strong and the tip not exposed to users, the tube plug connector 200 is resistant to unintended shock. Having a tube conductor instead of, e.g., a prong conductor, also contributes to the overall safety. The tube plug connector 200 is spring-biased, but instead of the spring residing in a male portion, the spring is hidden and resides in the female portion of the tube plug connector 200. All components are concentric.

Figure 17:
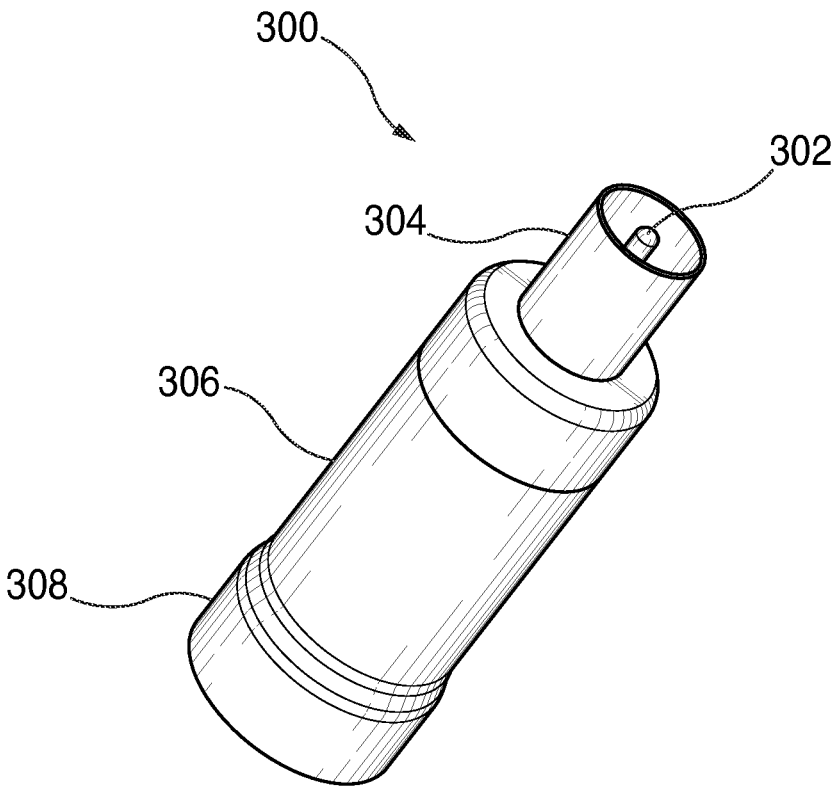
FIG. 17 is a view of the male portion of a tube conductor plug connector.

FIG. 17 is a view of the male portion 300 of a tube conductor plug connector 200. It consists of a tip 302, tube 304, body 306 and base 308. All of the components are concentric, rather than having some non-concentric components. That all the components are concentric simplifies manufacture and installation and promotes safety. Combined with the female portion spring biasing, this feature minimizes flicker when the pole is justled. For example, the tip 302 is completely housed within the tube 304 so as to not be exposed to users. In a preferred embodiment, the tube 304 is made of copper and acts as a conductor of electricity at any point along its outer surface area. The tree is illuminated when the tube 304 comes in contact with the female portion 400. The tube 304 acts to replace the pair of prongs typically found in other plug connectors. The body 306 of the tube conductor plug connector 200 is of a larger diameter than the tube's 304 diameter, but has a smaller diameter than the male portion's base 308. The base 308 of the male portion 300 is of a size that allows the tube plug connector 200 to be securely sandwiched within the trunk pole 500 of the artificial tree.

Figure 18:
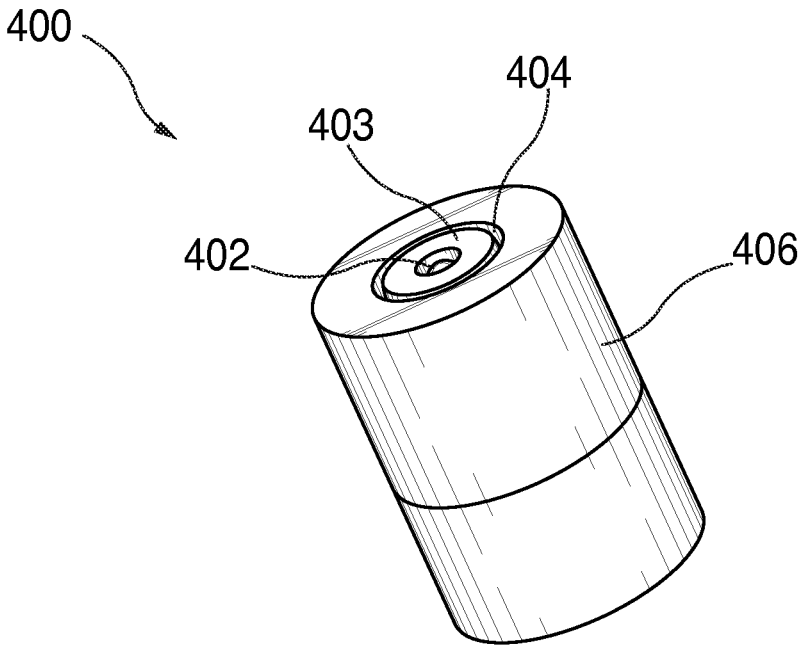
FIG. 18 is a view of the female portion of the tube conductor plug connector.

FIG. 18 is a view of the female portion 400 of the tube conductor plug connector. It consists of an aperture 402, cushion 403, rim 404 and body 406. Like the male portion 300, all components within the female portion 400 are symmetrically concentric. The aperture 402 is of a diameter that enables the tip 302 to be inserted into it. While the tip 302 fits inserted into the aperture 402, the cushion 403 of the female portion 400 fits inside the tube 304 of the male portion 300. The tube 304 fits neatly into the rim 404 of the female portion. In total, two components of the male portion 300 (tip 302 and tube 304) fit into the female portion 400 (aperture 402 and rim 404, respectively), while one component of the female portion (cushion 403) fits into the male portion (tube 304). This dual insertion structure helps to secure the connection of the plug because of the friction fit along the surface areas of each component. Since all of these components are concentric and radially uniform, the trunk pole segments can be inserted at any point along the perimeter of the tube conductor plug connector 200. The diameter of the body 306 of the male portion 300 equals the diameter of the body 406 of the female portion 400, and is slightly smaller than the diameter of the trunk pole itself such that the tube plug connector 200 fits snugly within the trunk pole 500. The base 308 of the male portion 300 has a diameter larger than the body 306, but still infinitesimally smaller than that of the trunk pole 500.

Figure 19:
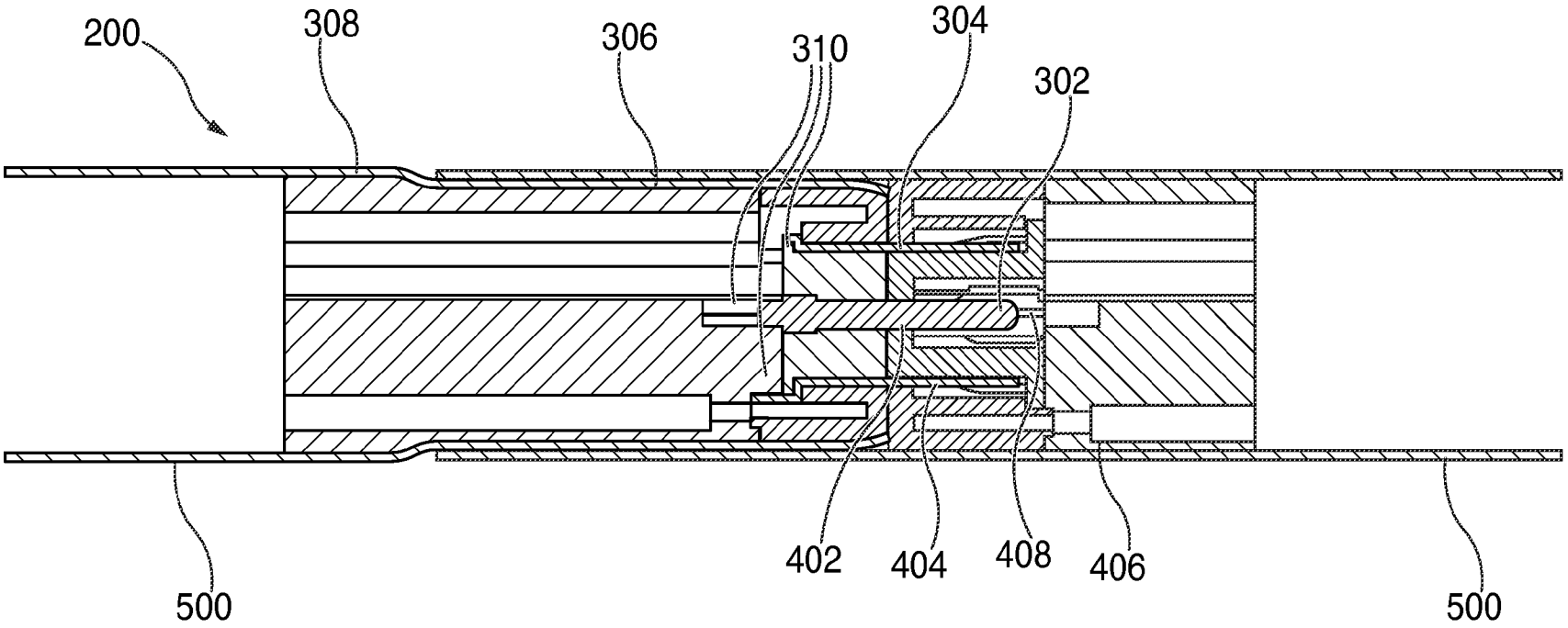
FIG. 19 is a schematic of the tube conductor plug connector with the male portion inserted into the female portion.

FIG. 19 is a schematic of the tube conductor plug connector 200 with the male portion 300 inserted into the female portion 400. The schematic is drawn to scale, and shows that in a preferred embodiment, the total length of the male portion 300 is 76 mm, and the total length of the female portion 400 is 40 mm. When plugged in, the total length of the tube plug connector 200 is 105 mm, and has a diameter of approximately 35 mm. The segment of the male portion 300 that is actually inserted into the female portion 400 is 11 mm, and the segment of the male portion 300 that is not inserted into the female portion 400 and visible to the user (if not inside the trunk pole 500) is 65 mm. This means that 11 mm of each of the tip 302 and tube 304 is housed inside of the female portion 400 when the plug is connected. The aperture 402 and rim 404 within the female portion are of a corresponding depth (11 mm). The tube plug connector 200 is never really meant to be taken out of the trunk pole 500. The tip 302 pushes up against a hidden spring 408 within the female portion. The tube 304 is a metal conductor which conducts electricity, and in a preferred embodiment is made of copper, although any type of metal capable of conducting electricity can be used. The tube 304 essentially replaces the pair of prongs which is typically found in plug connectors of this kind (e.g., cigarette lighters and plug connectors for artificial trees). Each of the male portion 300 and female portion 400 is meant to be permanently sandwiched within its respective trunk pole segment. In this way, assembly is simplified. The user merely connects the two trunk pole segments together, thereby plugging in the tube plug connector 200 to illuminate the tree. However, in case the tube plug connector 200 is actually removed from the trunk pole 500, it is a safer design, because the tip 302 is never exposed and the tip 302 and tube 304 is of a very strong material. As shown, the body 306 of the male portion 300 is of the same diameter of the body 406 of the female portion 400, which is approximately 35 mm. The base 308 has a diameter that approximately equals the diameter of the trunk pole 500. FIG. 19 also shows that the tube plug connector 200 comprises various other substructures that enable construction of the male and female portions and connectivity between the portions. Each substructure is highlighted by diagonal lines that run in parallel for each respective substructure, or solid white or black coloring. Not shown in the figure is wiring connected to both the male and female portions which run electrical current throughout in order to illuminate the tree.

Figure 20:
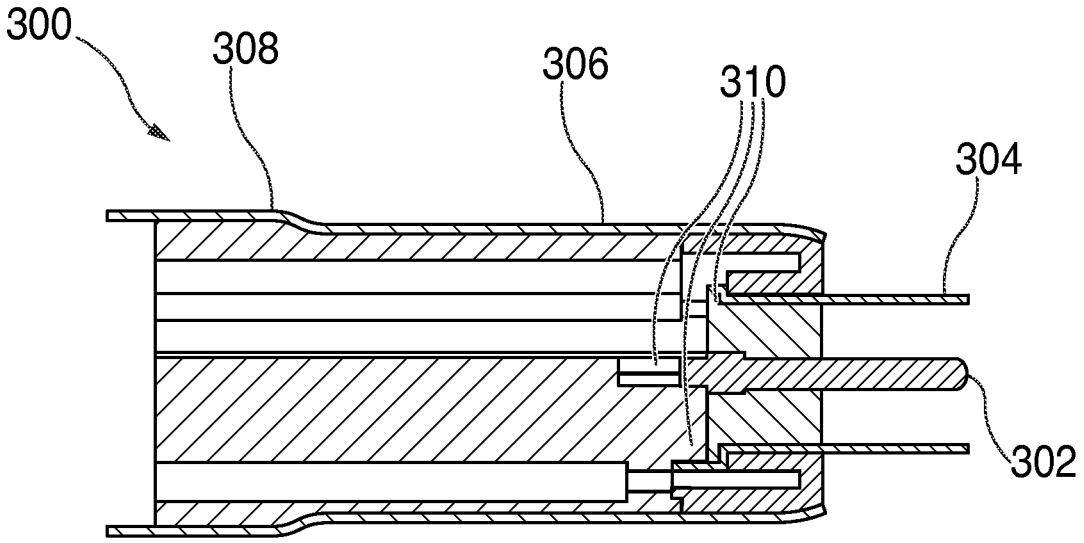
FIG. 20 is a schematic of the male portion of the tube conductor plug connector.

FIG. 20 is a schematic of the male portion 300 of the tube conductor plug connector 200, consisting of the tip 302, tube 304, body 306 and base 308. It is the same as the male portion shown in FIG. 19, except it is not plugged into the female portion. Also, the tip 302 and tube 304 are sufficiently rooted within cavities 310 inside the male portion such that they do not break off the male portion 300.

The tube plug connector is designed such that assembly is very easy. In normal use, an assembler would build the tree from the ground up as follows. First the assembler would locate the stand of the tree and place it on the ground where the tree is to be displayed. Next, the assembler would plug a transformer into an electrical outlet. This would give power to the stand instantly, and is the only time the assembler has to come into contact with an electrical outlet. Next, the assembler would typically insert eyebolts into the stand and begin twisting in a clock-wise motion for a few rotations only, leaving enough room for the bottom most trunk segment to be inserted into the stand. The branches of the tree will typically already be inserted into the trunk segments. If not, the user would insert the branches into the trunk segments (this can alternatively be done after each segment is connected, the process which is described below). Each segment of the trunk is labeled. For example, if there are four segments, the bottom most segment would be labeled 'D' and the top most segment 'A'. Therefore, in the case of four segments, the assembler would insert the 'D' labeled segment into the center of the stand and further twist the eyebolts until they can no longer be twisted and the 'D' segment secure. The assembler then inserts the 'C' labeled segment into the 'D' labeled segment, etc., until all segments are connected. The tube plug connector 200 is intra-pole. Therefore, in this case, the male portion 300 of the tube plug connector 200 would be sandwiched in the 'B' segment, and the female portion 400 would be sandwiched in the 'C' segment. The tube plug connector 200 is then automatically connected when the 'B' and 'C' trunk segments are connected. Each segment will light up upon its insertion into the previous segment. The tree will be lit completely when the segments of the tree are all combined.

While the above specification and example provide a description of the invention, many embodiments of the invention can be made without departing from the spirit and scope of the invention. It is to be understood that the foregoing embodiment is provided as illustrative only, and does not limit or define the scope of the invention. Various other embodiments are also within the scope of the claims.

I claim:

1. A radially uniform spring-biased intra-pole tube conductor plug connector for an electric artificial tree, comprising:

a male portion housed in one trunk segment;

a female portion housed in a different trunk segment;

a tubular metallic conductor that creates electrical contact at any point along its outer surface area when inserted into a rim of the female portion;

a tip of the male portion, said tip housed entirely within the tubular metallic conductor, to be inserted into an aperture of the female portion;

a cushion comprising a body of the female portion that is inserted into the tubular metallic conductor when the male portion is connected to the female portion;

a spring within the female portion to bias the female portion against the tip of the male portion;

whereby, the plug connector can create electrical contact anywhere along its radially uniform perimeter when the male portion is inserted into the female portion.

2. The tube conductor plug connector of claim 1, wherein when the trunk segments that comprise the male and female portions are connected, the plug connector is connected.

3. The tube conductor plug connector of claim 1, wherein the tube plug connector is capable of functioning at an electrical potential of 110-240 VAC.

4. The tube conductor plug connector of claim 1, wherein the tubular metallic conductor is made of copper.

5. The tube conductor plug connector of claim 1, wherein the male portion further comprises a base that is the same diameter of the trunk segments.

6. The tube conductor plug connector of claim 1, wherein the tubular metallic conductor facilitates flow of electrical current through an electrical tree.

7. The tube conductor plug connector of claim 1, wherein each of said tube conductor plug connector components are concentric.

* * * * *